United States Patent [19]

Tavernier et al.

[11] Patent Number: 4,853,311

[45] Date of Patent: Aug. 1, 1989

[54] FUSIBLE ELECTROSTATICALLY ATTRACTABLE TONER

[75] Inventors: Serge M. Tavernier, Lint; August M. Mariën, Oevel; Herman J. Uytterhoeven, Bonheiden, all of Belgium

[73] Assignee: AGFA-Gavaert N.V., Martsel, Belgium

[21] Appl. No.: 156,957

[22] Filed: Feb. 18, 1988

[30] Foreign Application Priority Data

Feb. 24, 1987 [EP] European Pat. Off. ..... 87200288.6

[51] Int. Cl.[4] ..... G03G 9/08; G03G 9/06

[52] U.S. Cl. ..... 430/106; 430/106.6; 430/109; 430/111; 430/904; 524/904

[58] Field of Search ..... 430/109, 111, 904, 106, 430/106.6; 524/904

[56] References Cited

U.S. PATENT DOCUMENTS

| | | | |
|---|---|---|---|
| 3,941,898 | 3/1976 | Sadamatsu et al. | 430/109 X |
| 4,340,660 | 7/1982 | Kiuchi et al. | 430/106.6 |
| 4,572,885 | 2/1986 | Sato et al. | 430/109 X |

FOREIGN PATENT DOCUMENTS

| | | | |
|---|---|---|---|
| 3017657 | 11/1980 | Fed. Rep. of Germany . | |
| 61-39055 | 2/1986 | Japan | 430/109 |
| 2070036 | 9/1981 | United Kingdom . | |

*Primary Examiner*—Paul R. Michl
*Assistant Examiner*—Jeffrey A. Lindeman
*Attorney, Agent, or Firm*—William J. Daniel

[57] ABSTRACT

A toner composition comprised of electrostatically attractable fusible powder particles, having an average particle size in the range of 1 to 100 μm and a melt viscosity at 190° C. in the range of 20 to 200 Pa.s, said powder particles comprising a coloring substance, a polymeric binder which consists essentially of a copolymer of:

(1) styrene or styrene homologue, (2) an alkyl acrylate or alkyl methacrylate monomer, wherein alkyl is a straight chain of at least 8 carbon atoms, and (3) a crosslinking monomer containing at least two ethylenically unsaturated groups, the binder copolymer constituting more than 50% of the total weight of the powder particles.

12 Claims, No Drawings

FUSIBLE ELECTROSTATICALLY ATTRACTABLE TONER

DESCRIPTION

The invention relates to a toner composition consisting of fusible electrostatically attractable toner particles suitable for being fixed to paper by heat- and pressure fusing, and also relates to a method for fixing such toner particles by heat- and pressure fusing.

It is well known in the art of electrophotographic copying to form an electrostatic latent image corresponding to an original to be copied on a photoconductive member. The latent image is developed with a finely divided developing material or toner to form a powder image which is then transferred onto a support sheet such as paper. The support sheet bearing the toner powder image is subsequently passed through a fusing apparatus and is thereafter discharged out of the copying machine as a final copy.

There are three generally known types of fusing processes used for fixing a toner powder image to its support. The first is an oven heating process in which heat is applied by hot air over a wide portion of the support sheet, the second is a flash heating process in which heat is produced in the toner by absorption of light energy emitted by a flash lamp and the third is a pressure heating process wherein the support with the toner image is simultaneously pressed and heated.

In a common heat- and pressure fusing process the support carrying the non-fixed toner image is conveyed through the nip formed by a fuser roller and another roller backing the support and functioning as pressure exerting roller.

The last mentioned process offers several advantages from the viewpoint of simplicity of heating equipment and more economical use of energy without burning or scorching the support material but has to proceed within a rather narrow temperature range to avoid image quality degradation.

If the fuser roller provides too much thermal energy to the toner and paper the toner will melt to a point where its cohesion and viscosity is so low that "splitting" can occur, and some of the toner is transferred to the fuser roller. When splitting does occur the toner which is taken up by the fuser roller is usually transferred to the next copy sheet, giving rise to the phenomenon of "hot offset". This occurs when there is inadequate release (cleaning) of the toner particles picked up by the fuser roller. Such release is provided commonly by wetting the fuser roller with silicone oil.

If too little thermal energy is provided then the toner particles may fuse together but not fix (adhere) to the paper—especially since the thermal energy is delivered through the toner. The unfixed toner particles will likewise be deposited onto the next copy sheet resulting in what is called "cold offset". In both cases some toner will be transferred to the pressure roller during the interval between subsequent paper feedings. Moreover, too little thermal energy results in poor adhesion to the paper resulting in poor fixing.

In order to prevent as much as possible the above described toner offset problems the fuser roller is coated with an abhesive material such as silicone rubber and silicone oil, or is provided with a smooth coating of polytetrafluoroethylene resin having a very low friction coefficient and low adhesivity to hydrophobic materials. Although, such coating prevents toner offset to a certain extent, a completely satisfactory solution to the problem is not achieved when the properties of the toner are not carefully selected within proper ranges. In this respect it has been established experimentally by us that by including in the toner particles selected resins containing structural units comprising a relatively long aliphatic chain and having a relatively high crosslinking degree provide a good release of the toner from a hot fuser roller without splitting during heat and pressure fixing. Moreover, such toner adheres very well to paper showing no cold offset so that the fixing can proceed within a relative broad temperature range.

It is an object of the present invention to provide an improved fusible electrostatically attractable toner suitable for forming fixed toner images without toner offset in heat- and pressure fusing.

It is another object of the present invention to provide toner developer particles containing synthetic resin constituents giving the toner a broad fusing window for clean and rapid heat- and pressure fusing. Other objects and advantages will become apparent from the further description.

In accordance with the present invention a toner composition consisting of electrostatically attractable fusible powder particles is provided, said composition having an average particle size in the range of 1 to 100 μm, and a melt viscosity at 190° C. in the range of 20 to 200 Pa.s measured as defined hereinafter, said toner composition comprising a colouring substance and consisting for more than 50% by weight of the total toner particle composition of a copolymer of:

(1) styrene or styrene homologue, (2) an alkyl acrylate or alkyl methacrylate monomer of which the alkyl chain is a straight chain of at least 8 carbon atoms in straight line, and (3) a crosslinking monomer containing at least two ethylenically unsaturated groups, and wherein (2) is present in copolymerized form in said copolymer in an amount of at least 5% and at most 50% by weight of the monomers, and the amount of (3) in copolymerized form in said copolymer is sufficient to obtain a gel content G in said copolymer of 20 to 65% by weight, the gel content being determined by the following test:

50 mg of the copolymer are shaken for 2 h at 20° C. in 10 ml of tetrahydrofuran, whereupon the obtained liquid is subjected to centrifuging for 30 minutes at 900 rpm at a radius of 8.5 cm. The amount of dissolved product in the supernatant liquid is determined gravimetrically after evaporation of the solvent. The gel content G as weight percentage is calculated with the following equation:

$$G=[1-(C\times 0.2)]\times 100$$

wherein:

C is the concentration of dissolved polymer in supernatant liquid expressed in mg/ml.

The average number molecular weight (MN) of the copolymer fraction soluble in tetrahydrofuran is preferably lower than 20,000 and preferably in the range of 7,500 to 15,000. Said molecular weight is determined by gel permeation chromatography (GPC) known to those skilled in the art.

The melt viscosity of the toner has been measured with a Rheometrics RVE-M (trade name of Rheometrics, Inc. 2438 U.S. Highway No. 22 Union, N.J., 07083, U.S.A.) viscosimeter containing two parallel rotatable disks with a diameter of 25 mm and spaced apart by a gap of 1 to 2 mm wherein the toner is arranged. The measurement of the melt viscosity proceeds by applying an oscillatory movement to the upper disc and measuring the mechanical coupling towards the disc underneath which is linked to a transducer transforming the resulting torsion values into Pa.s. Shear deformation is obtained by oscillatory movement proceeding at an angular frequency of 100 rad/s and with amplitude of 1% strain.

The measurement is done after 5 minutes of thermal equilibration at 190° C.

Suited homologues of styrene for use as monomer (1) in the preparation of the above defined copolymer are e.g. Alpha-methyl-styrene, p-methyl-styrene and p-tert-.butyl-styrene.

Particularly suited alkyl esters of acrylic or methacrylic acid for use as monomer (2) in the preparation of said copolymer are alkyl esters derived from aliphatic alcohols having at least 12 carbon atoms in a straight chain, e.g. dodecyl alcohol, n-hexadecyl alcohol and n-octadecyl alcohol.

In preferred crosslinking monomers (3) the ethylenically unsatured groups are conjugated with an ester or amide structure. The following compounds are specific examples of monomers (3): divinyl benzene, triallylcyanurate, N,N-diallylmelamine, esters of polyols with Alpha,Beta-unsaturated mono-acids, e.g. ethylene glycoldimethacrylate, diethylene glycol diacrylate, glycerol diacrylate, glycerol triacrylate, 1,2,4-butane triol trimethacrylate, 1,4-benzene diol dimethacrylate, pentaerythritol tetramethacrylate and mixed esters of ethylenically unsaturated monocarboxylic acids with pentaerythritol, the bis-acrylates and methacrylates of polyethylene glycols having an average molecular weight 200–500, methylene bisacrylamide, methylene bismethacrylamide, 1,6-hexamethylene bis-acrylamide and diethylene triamine tris-methacrylamide.

The preparation of the above defined copolymers for use according to the present invention proceeds preferably by suspension polymerization in one step.

The following preparations 1 to 6 give a detailed description of the suspension polymerization applied in the production of copolymers suited for use according to the present invention. Preparation 7 represents the synthesis of a copolymer used in a comparative test with respect to the copolymers of preparations 1 to 6.

PREPARATION 1

Copoly(styrene/n-octadecylmethacrylate/ethylene glycol dimethacrylate)(82.6/16/1.4 wt. %)

In a double-wall 10 glass-reactor provided with stirrer, thermometer, reflux condenser, nitrogen inlet, cooling spiral and thermostatic device for controlling the reaction temperature were introduced:

5000 ml of demineralized water and 50 g of copoly(-vinyl alcohol/vinyl acetate)(80/20 wt.) as dispersing aid. The solution was heated to 90° C. while stirring and introducing nitrogen gass. At that temperature over a period of 20 min the following ingredients were introduced:

benzoylperoxide: 37.5 g
styrene: 826 g
n-octadecyl methacrylate: 160 g
ethylene glycol dimethacrylate: 14 g Polymerization was carried on for 20 h at 90° C. while stirring.

After cooling the formed pearls were separated by suction filtering, once washed with water and twice with metanol. The copolymer pearls were dried at 40° C. up to constant weight value. Polymer yield about 85% of the theoretical value. The gel content determined as described above was 50% by weight.

PREPARATION 2

Preparation 1 was repeated with the following modified monomer composition: 88.9% wt of styrene, 10% wt of n-octadecylmethacrylate (n-ODMA) and 1.1% wt of ethylene glycol dimethylacrylate (EGDMA).

Polymer yield about 81.3% of the theoretical value. The gel content determined as described above was 21%.

PREPARATION 3–6

Preparation 1 was repeated with modified monomer compositions as defined in Table I hereinafter including polymer yield (% of theoretical value) and gel content (% by weight).

TABLE I

| Preparation | n-ODMA | EGDMA | Yield | Gel content |
|---|---|---|---|---|
| 3 | 10.0 | 1.4 | 70 | 42 |
| 4 | 17.1 | 1.2 | 81 | 34 |
| 5 | 16.0 | 1.3 | 84.5 | 36 |
| 6 | 17.1 | 1.5 | 84.5 | 54 |

PREPARATION 7

(for comparative test purposes)

Copoly(styrene/2-ethylhexyl acrylate/ethylene glycol dimethacrylate) (78.8/20/1.2% by weight)

In a double-wall 10 glass-reactor provided with stirrer, thermometer, reflux condenser, nitrogen inlet, cooling spiral and thermostatic device for controlling the reaction temperature were introduced:

5000 ml of demineralized water and 50 g of copoly(vinyl alcohol/vinyl acetate)(80/20 wt.) as dispersing aid. The solution was heated to 90° C. while stirring and introducing nitrogen gass. At that temperature over a period of 15 min the following ingredients were introduced:

benzoylperoxide: 37.5 g
styrene: 788 g
2-ethylhexyl acrylate: 200 g
ethylene glycol dimethacrylate: 12 g Polymerization was carried on for 8 h at 90° C.

After cooling the formed pearls were separated by suction filtering, once washed with water and twice with methanol. The copolymer pearls were dried at 40° C. up to constant weight value. Polymer yield about 95% of the theoretical value. The gel content determined as described herein before was 24%.

For optimizing the toner properties in admixture with the above defined copolymer(s) other resins or pigments modifying the melt viscosity may be used and/or release agents assisting in the release of the toner melt from the fuser roller. Particularly suited for that purpose are adhesion promoting compounds, e.g. talcum, silicones, fluorine containing polymers and natural or synthetic waxes.

Suitable fluorine containing vinyl polymers having a particularly low friction coefficient (static friction coefficient with respect to steel below 0.2) for preventing toner offsetting on the fuser roll are described in U.S. Pat. No. 4,059,768.

Particularly suitable for preventing toner-offsetting are waxy polyalkylene resins, more particularly an isotactic polypropylene having an average molecular weight of 14,000.

In order to bring the melt viscosity of the toner in the desired range a pigment, preferably having a density ($g.cm^{-3}$) larger than 1.8, may be added and mixed with the molten toner composition that on cooling is crushed and ground to obtain the desired particle size.

Pigments suitable for that purpose are e.g. titanium dioxide (rutile) having a density of 4.26, barium sulphate (barite) having a density of 4.5, ferric oxide ($Fe_2O_3$=-hematite) and ferrosoferric oxide ($Fe_3O_4$=magnetite) having respectively a density of 5.24 and 5.18 (ref. Handbook of Chemistry and Physics, 42nd ed., published by The Chemical Rubber Publishing Co., 2310 Superior Ave. N.E. Cleveland, Ohio—U.S.A.)

The latter two pigments serve also as colouring substance e.g. in magnetic toners. Therefore, the present invention includes toners wherein said pigment serves wholly or partially as the colouring substance.

The colouring substance used in the toner particles may be any inorganic pigment (including carbon) or solid organic dyestuff pigment or mixtures thereof commonly employed in dry electrostatic toner compositions. Thus, use can be made e.g. of carbon black and analogous forms thereof, such as lamp black, channel black, and furnace black e.g. Spezialschwarz IV (tradename of Degussa Frankfurt/M, W.Germany) and Cabot Regal 400 (trade name of Cabot Corp. High Street 125, Boston, U.S.A.).

Typical solid organic dyestuffs are so-called pigment dyes, which include phthalocyanine dyes, e.g. copper phthalocyanines, metal-free phthalocyanines, azo dyes, and metal complexes of azo dyes.

The following dyes in pigment form are given for illustration purposes only: Fanalrosa B Supra Pulver (trade name of Badische Anilin & Soda-Fabrik AG, Ludwigshafen, Western Germany, Heliogenblau LG (trade name of BASF for a metal-free phthalocyanine blue pigment), MONASTRAL BLUE (a copper phtalocyanine pigment, C.I. 74,160). Heliogenblau B Pulver (trade name of BASF), Helioechtblau HG (trade name of Bayer AG, Leverkusen, Western Germany, for a copper phthalocyanine C.I. 74,160), Brilliant Carmine 6B (C.I. 18,850), and Violet Fanal R (trade name of BASF, C.I. 42,535).

Typical inorganic pigments include black iron(III) oxide and mixed copper(II) oxide/chromium(III) oxide/iron(III)oxide powder, milori blue, ultramarine cobalt blue, and barium permanganate. Further can be mentioned: the pigments described in the French Patent Specifications No. 1,394,061 filed Dec. 23, 1963 by Kodak Ltd. and 1,439,323 filed Apr. 27, 1965 by Harris Intertape Corporation.

To improve or control the chargeability of the toner particles one or more charge control agent is added to the toner particle composition as described e.g. in the published German patent application (DE-OS) No. 3,022,333 for yielding negatively chargeable toner particles or for yielding positively chargeable toner particles as described e.g. in the published German Patent application (DE-OS) No. 2,362,410 and the U.S. Patent Specification Nos. 4,263,389 and 4,264,702. A very useful charge control agent for offering positive charge polarity is Bontron NO4 (trade name of Oriental Chemical Industries - Japan) being a resin acid modified nigrosine dye which may be used e.g. in an amount up to 5% by weight with respect to the toner particle composition. A very useful charge control agent for offering negative charge polarity is BONTRON S36 (trade name of Oriental Chemical Industries—Japan) being a metal complex dye which may be used e.g. in an amount up to 5% by weight with respect to the toner particle composition.

In the preparation of the toner the colouring material is added to the molten copolymer resin and subjected to stirring until a homogeneous mixture is obtained. After cooling, the solid mass obtained is crushed and ground e.g. in a hammer mill followed by a jet-mill to an average particle size of 1 to 100 microns. Preferably the fraction having a particle size between 1–30 μm is used.

The colouring material is normally used in an amount of 5 to 20% by weight calculated on the total weight of toner.

In order to improve the flow properties of the toner the toner particles may be admixed with a metal soap e.g. zinc stearate as described e.g. in the United Kingdom Patent Specification No. 1,379,252. The preferred proportions of metal soap such as zinc stearate to toner material are in the range of 0.05 to 1% by weight. For the same purpose colloidal silica may be used, alone or in addition to the metal soap. The use of silica as flow improving agent for toner compositions is described in the United Kingdom Patent Specification No. 1,438,110.

The colloidal silica particles used in the developer composition according to the present invention are preferably free from pores i.e. have a smooth substantially spherical surface. Their specific surface area is preferably in the range of 100 to 400 sq.m/g.

Colloidal silica particles suitable for use according to the present invention are commercially available under the Trade Marks Aerosil and CAB-O-SIL marketed by Degussa, Frankfurt (M), W. Germany and Cabot Corp. Oxides Division, Boston, Mass., U.S.A. respectively. Aerosil 300 is a colloidal silica having a specific surface area of 300 sq.m/g. The specific surface area can be measured by a method described by Nelsen and Eggertsen in "Determination of Surface Area Adsorption Measurements by continuous Flow Method", Analytical Chemistry, Vol. 30, No. 8 (1958) 1387–1390.

The preferred proportions of colloidal silica to toner material are in the range of 0.1 to 0.5% by weight.

For a given charge density of the latent image charge-carrying surface the maximum development density attainable with toner particles of a given size is determined by the charge/toner particle mass ratio, which is determined substantially by the triboelectric charge obtained by friction contact e.g. with carrier particles or applicator used.

The toner compositions of the present invention may be used as monocomponent toners but they are preferably used in combination with carrier particles. Hot roll fusing of monocomponent toners is described e.g. in Journal of Imaging Technology, Vol. 11, No. 6, Dec. 1985, p. 261–279.

The development may proceed by so-called cascading the toner particles over the imaging surface containing the electrostatic charge pattern or with magnetic brush. The carrier particles, if such are employed, may be electrically conductive, insulating, magnetic or non-magnetic (for magnetic brush development they must be magnetic), as long as the carrier particles are capable of triboelectrically obtaining a charge of opposite polarity to that of the toner particles so that the toner particles adhere to and surround the carrier particles.

In developing a positive reproduction of an electrostatic image, the carrier particle composition and/or toner particle composition is selected so that the toner particles acquire a charge having a polarity opposite to that of the electrostatic latent image so that toner deposition occurs in image areas. Alternatively, in reversal reproduction of an electrostatic latent image, the carrier particle composition and toner particle composition is selected so that the toner particles acquire a charge having the same polarity as that of the electrostatic latent image resulting in toner deposition in the non-image areas.

Useful carrier materials include sodium chloride, ammonium chloride, aluminium potassium chloride, Rochelle salt, sodium nitrate, aluminium nitrate, potassium chlorate, granular zircon, granular silicon, silica, methyl methacrylate, glass, steel, nickel, iron, ferrites, ferromagnetic materials, e.g. magnetite, whether or not coated with a polymer skin. Other suitable carrier particles include magnetic or magnetizable materials dispersed in powder form in a binder droplet as described e.g. in U.S. Pat. No. 4,600,675. The carriers may be employed with or without a coating. Many of the foregoing and typical carriers are disclosed in U.S. Pat. Nos. 2,618,441; 2,638,416; 2,618,522; 3,591,503 and 3,533,835 directed to electrically conductive carrier coatings, and U.S. Pat. No. 3,526,533 directed to polymer coated carriers. Oxide coated iron powder carrier particles are described e.g. in U.S. Pat. No. 3,767,477. The U.S. Pat. No. 3,847,604 and 3,767,578 relate to carrier beads on the basis of nickel. An ultimate coated carrier particle diameter between about 30 microns to about 1000 microns is preferred. The carrier particles possess then sufficient inertia to avoid adherence to the electrostatic images during the cascade development process and withstand loss by centrifugal forces operating in magnetic brush development. The carrier may be employed with the toner composition in any suitable combination, generally satisfactory results have been obtained when about 1 part of toner is used with about 5 to about 200 parts by weight of carrier.

The toner compositions of the present invention may be used to develop electrostatic latent images on any suitable electrostatic surface capable of retaining charge, particularly photoconductive layers known in the art including conventional photoconductors.

The present toner composition when containing a magnetically attractable pigment e.g. $Fe_3O_4$ (black) serving also partially or solely as colouring agent can be used for magnetic brush development of electrostatic charge patterns as well as for the development of latent magnetic images. The development of latent magnetic images is described e.g. in U.S. Pat. No. 4,271,248 wherein a magnetically attractable toner suitable for flash-fusing fixing is described.

For fixing a toner image to a sheet or web support, e.g. a paper sheet, the above described toner after being deposited in image configuration on said support is conveyed between means that exert substantially equal pressure on the front and rear side of said support, while at least the means directed to the front side and contacting the toner particles is at a temperature sufficient to fuse the toner particles and has a surface with abhesive character of such a degree that its contact angle with respect to n-butanol at 20° C. is 0°.

In a preferred embodiment said toner-image bearing support is conveyed through the nip formed by rollers rotating in opposite direction, wherein the roller contacting the toner image contains a heating source e.g. infra-red radiator or electrical resistance heating element. In most apparatus for providing the necessary pressure a spring pressure mechanism is used to bias the pressure roller which is a support roller contacting the rear side of the toner-image bearing support. An example of a preferred toner fixing apparatus containing a fuser and pressure roller with self-adjusting pressure mechanism is described in the U.S. Patent Specification No. 4,269,594. Other roller fusing devices for fixing toner images are provided with a pneumatically operated bladder to apply an equal pressure to all toner image parts. Examples of such devices are disclosed in Research Disclosure September 1981 items 20904, 20906 and 20914.

In an embodiment for carrying out the present heat and pressure fixing process on non-metal supports, e.g. paper supports, the fuser roller consists of a tube in aluminium or stainless steel having e.g. an inner diameter of 40 to 45 mm, a wall thickness of 1 to 2 mm and a length of 230 mm onto which a layer of polytetrafluorethylene with a thickness of 20 to 60 μm is provided. Within the tube, and centrally located is provided a 500 to 1000 Watt halogen flood light lamp. This type of lamp enables the fuser roller to attain a surface temperature of about 180° C. in standby position. The pressure roller acting as support roller co-operating with said fuser roller is a solid cylinder of stainless steel, copper or aluminium that may be internally heated and onto which a layer of silicone rubber with a thickness in the range of 3 to 10 mm having a Shore A hardness in the range of 30 to 60 has been applied.

The pressure roller and the heat fuser roller are mounted in contact with each other and the pressure at the area of contact with the toner is adjusted at a value in the range of 1 to 2 kg per cm of the tangent line between the rollers. Operating with the above rollers under the above circumstances of pressure a tangent line with a width of in the range of 5 to 9 mm is obtained. The pressure between the fuser and pressure roller can be controlled by spring or pneumatically.

According to a preferred embodiment the fuser roller is cleaned with a web, e.g. porous paper web, impregnated with silicone oil.

According to a particularly advantageous embodiment upstream of the fuser roller a heating element, e.g. in the form of a resistor heated conveyor roller or plate, is arranged to provide some pre-heating whereby the temperature of the fuser roller can be lowered.

According to a special embodiment the pressure in the present heat-and-pressure fixing process is applied with an optionally heated endless belt made e.g. of elastomer or metal coated with elastomer layer.

The toner composition according to the present invention allows support pass-through speeds between the rollers in the range of 10 to 30 $cm.s^{-1}$, the heating roller temperature being in the range of 120 to 210° C.

The following examples illustrate the invention without, however, limiting it thereto. All parts, ratios and percentages are by weight unless otherwise defined.

EXAMPLE 1

Toner preparation 88.25 parts of the copolymer prepared according to preparation 1, 6 parts of carbon black (average particle size 25 nm), 0.75 parts of Bontron S36 (trade name) as negative charge controlling agent and 5 parts of isotactic polypropylene (melting point: Tm=145° C.) are mixed in a kneader and heated at 153° C. to form a melt.

After about 30 minutes the kneading was stopped and the mixture was allowed to cool to room temperature (20° C.). At that temperature the mixture was crushed and milled to form a powder. The obtained powder was further reduced in grain size by jet mill to obtain an average particle size of 9 μm.

To improve the flow properties of the toner 0.2 parts of colloidal silica (average particle size 20 nm) were admixed thereto. Viscosity: 70.2 Pa.s measured at 190° C. as defined herein.

Development and Transfer

An electrostatic image formed on a conventional electrophotographic recording element, i.e. selenium photoconductor coated conductive drum, which was positively charged and image-wise exposed to light, was developed by magnetic brush with the obtained toner mixed with iron bead carrier particles.

The transfer of the electrophoretically deposited toner proceeded by applying a positive voltage of 3 kV to a metal roll, which was kept in close ohmic contact with the rear side of a paper sheet acting as receiving material whose front side was therefore kept in close contact with the toner image on the photoconductor.

Fixation

The image-wise transferred toner particles were fed to a heat-and-pressure roller fixing device.

In said device the fuser roller consists of a tube in stainless steel or brass having an inner diameter of 41 mm, a wall thickness of 1.2 mm and a length of 230 mm onto which a layer of silicone rubber with a thickness of 1.0 mm is provided. Within the tube, and centrally located is provided a 1000 Watt halogen flood light lamp. This lamp enables the fuser roller to attain a surface temperature of 210° C. in standby position. The pressure roller acting as support roller co-operating with said fuser roller is a solid cylinder of stainless steel onto which a layer of silicone rubber with a thickness of 7 mm is provided. The diameter of the roller is 44 mm. The pressure roller was cleaned from paper dust by contacting it with a silicone-oil impregnated wick.

The pressure roller and the heat fuser roller were mounted in contact with each other and the pressure at the area of contact with the toner is adjusted at a value of 1.0 kg per cm tangent line between the rollers.

The pass-through speed of the receiving paper carrying the toner image was 10 cm/s and the surface temperature of the heating roller was 180° C.

For the assessment of the degree of fixation a "folding test" was carried out.

In the test procedure a solid black area of deposited toner (1 mg/cm$^2$) is folded, the folded edge being compressed between two metal rollers with nip loading operating as follows:

travelling speed: 20 cm/s, pressure: free weight of the upper roller 600 g + weight of the ball bearings: 40 g.

width: 10 cm.

The unfolded area is then rubbed with common copying paper used in xerography under the following conditions:

friction pressure: 50 g/cm$^2$ friction velocity: 0.15 m/s number of rub streaks: 5.

The fixation degree is defined as the ratio of optical densities (D2/D1) measured on the folded and friction-treated black area versus that of the non-folded area. A density ratio (D2/D1) of 0.8/1 is considered to correspond with a high fixation degree.

The temperature (T-fix ° C.) of the fuser roller necessary to give such high fixation degree is given furtheron in Table II following the examples.

In Table II also the viscosity of the toner (Pa.s at 190° C.) and the hot off-setting temperature (HT-off ° C.) are listed.

EXAMPLES 2 to 6

Analogously to the procedure of Example 1 toners were prepared with the polymers obtained according to preparations 2 to 6. The toner particles were mixed with carrier particles and used in magnetic brush development and thereupon subjected to fixation as described in Example 1.

Viscosity and fixation results are listed in Table II.

EXAMPLE 7 (comparative example)

The toner preparation of Example 1 was repeated with the difference however, that the short-chain alkyl copolymer of preparation 7 was used instead of the copolymer of preparation 1.

Viscosity and fixation results are listed in Table II.

EXAMPLE 8

The toner preparation of Example 1 was repeated with the difference however, that the negative charge control agent Bontron S36 (trade name) was replaced by a same weight of positive charge control agent Bontron NO4 (trade name).

After jet-milling and classification 0.1% wt of colloidal silica Aerosil R 972 (trade name) with respect to the toner weight was added.

The toner was used in admixture with magnetic carrier particles in reversal development wherein a biasing voltage of +400 V was applied to the developing roller.

TABLE II

| Example | Viscosity Pa.s | T-fix °C. | HT-off °C. |
|---|---|---|---|
| 1 | 70.2 | 160 | >200 |
| 2 | 48.4 | 150 | 180 |
| 3 | 78.5 | 170 | >200 |
| 4 | 29.5 | 150 | 190 |
| 5 | 69.7 | 160 | >200 |
| 6 | 52.3 | 160 | 200 |
| 7* | 33.7 | 150 | 175 |
| 8 | 72.0 | 165 | >200 |

Example 7* is a comparative test with the resin of preparation 7.

Example 7* is a comparative test with the resin of preparation 7.

From the data given in Table II can be learned that the presence of a long aliphatic chain in the alkyl methacrylate monomer used in the copolymer preparation increases the fixation latitude, which is the difference between temperature of good fixation (T-fix ° C.) and temperature of hot off-setting (HT-off ° C.).

We claim:

1. A toner composition comprising electrostatically attractable fusible powder particles having an average particle size in the range of 1 to 100 μm and a melt viscosity at 190° C. in the range of 20 to 200 Pa.s measured as defined herein, said powder particles containing a colouring substance and a polymeric binder, said polymeric binder consisting essentially of a copolymer of:

(1) styrene or styrene homologue, (2) an alkyl acrylate or alkyl methacrylate monomer wherein alkyl is a straight chain of at least 8 carbon atoms, and (3) a crosslinking monomer containing at least two ethylenically unsaturated groups, wherein said monomer (2) constitutes at least 5% and at most 50% by weight of the copolymer, the amount of said monomer (3) is sufficient to impart to said copolymer a gel content of 20 to 65% by weight, the gel content being determined by the test defined herein, and said copolymer constitutes more than 50% of the total weight of said powder particles.

2. A composition according to claim 1, wherein the alkyl acrylate or methacrylate monomer (2) is an alkyl ester derived from an aliphatic alcohol having at least 12 carbon atoms in a straight chain.

3. A composition according to claim 1, wherein said crosslinking monomer (3) has at least two ethylenically unsaturated groups conjugated with an ester or amide structure.

4. A composition according to claim 1, wherein the binder copolymer is prepared by suspension polymerization.

5. A composition according to claim 1, wherein the colouring substance is carbon black.

6. A composition according to claim 1, wherein the toner particles contain a magnetic or magnetizable pigment.

7. A composition according to claim 18, wherein said pigment is ferric oxide or ferrosoferric oxide, and constitutes at least part of said colouring substance.

8. A composition according to claim 1, wherein said powder particles include a release agent assisting in the release of the toner melt from a fuser roller and selected from the group consisting of talcum, silicones, fluorine-containing polymers and natural or synthetic waxes.

9. A composition according to claim 1, wherein said pigment particles include a pigment to bring the melt viscosity thereof in the desired range.

10. A composition according to claim 1, wherein the toner composition further comprises colloidal silica and/or zinc stearate and/or fluorinated wax to improve the flow thereof.

11. A composition according to claim 1, wherein the toner particles contain a negative or positive charge control agent.

12. A xerographic developer composition wherein toner particles, according to claim 1, are mixed with carrier particles for cascade or magnetic brush development of electrostatic charge patterns.

* * * * *

UNITED STATES PATENT AND TRADEMARK OFFICE

CERTIFICATE OF CORRECTION

PATENT NO. : 4,853,311

DATED : August 1, 1989

INVENTOR(S) : Serge M. Tavernier et al.

It is certified that error appears in the above-identified patent and that said Letters Patent is hereby corrected as shown below:

In the claims:

Column 12, line 4, "18" should read -- 6 --.

Signed and Sealed this

Twenty-second Day of May, 1990

*Attest:*

HARRY F. MANBECK, JR.

*Attesting Officer*

*Commissioner of Patents and Trademarks*